US008826701B2

(12) United States Patent
Hong et al.

(10) Patent No.: US 8,826,701 B2
(45) Date of Patent: Sep. 9, 2014

(54) LAUNDRY MACHINE

(75) Inventors: Sang Wook Hong, Seoul (KR); Jae Won Chang, Seoul (KR); Sun Young Park, Seoul (KR); Bon Kwon Koo, Seoul (KR); Ki Young Kang, Seoul (KR); Ji Hee Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 178 days.

(21) Appl. No.: 13/260,071

(22) PCT Filed: Sep. 11, 2009

(86) PCT No.: PCT/KR2009/005195

§ 371 (c)(1),
(2), (4) Date: Sep. 23, 2011

(87) PCT Pub. No.: WO2010/128734

PCT Pub. Date: Nov. 11, 2010

(65) Prior Publication Data

US 2012/0042697 A1 Feb. 23, 2012

(30) Foreign Application Priority Data

May 4, 2009 (KR) ..... 10-2009-0039049

(51) Int. Cl.

| | |
|---|---|
| ***D06F 21/02*** | (2006.01) |
| ***D06F 21/10*** | (2006.01) |
| ***D06F 23/06*** | (2006.01) |
| ***D06F 37/04*** | (2006.01) |
| ***D06F 37/10*** | (2006.01) |
| ***D06F 33/02*** | (2006.01) |

(52) U.S. Cl.

CPC ..... *D06F 33/02* (2013.01); *D06F 2214/00* (2013.01); *D06F 2232/00* (2013.01)

USPC ..... 68/24; 68/23 R; 68/25; 68/140; 68/196

(58) Field of Classification Search

USPC ..... 68/12.23

See application file for complete search history.

(56) References Cited

U.S. PATENT DOCUMENTS 6,286,344 B1 * 9/2001 Jeon et al. ..... 68/23.1
2004/0231062 A1 * 11/2004 Sharrow ..... 8/158

(Continued)

FOREIGN PATENT DOCUMENTS

EP 1529866 A1 5/2005
JP 6277395 A 10/1994

(Continued)

OTHER PUBLICATIONS

Ishikawa et al., "JP2006314561 English Machine Translation.pdf", Nov. 24, 2006—Machine translation from Patent Abstracts of Japan (PAJ).*

(Continued)

*Primary Examiner* — Michael Barr
*Assistant Examiner* — Levon J Shahinian
(74) *Attorney, Agent, or Firm* — Fish & Richardson P.C.

(57) ABSTRACT

A laundry machine that treats laundry housed in a rotating drum is disclosed. The laundry machine includes a cabinet (110), a tub (120) provided in the cabinet (110) to store wash water, a drum (130) rotatably provided in the tub (120) to house laundry, an angle change device (170) to change a tilting angle of a rotation shaft (144) of the drum (130), and a controller to control an operation of the angle change device (170) and a rotating operation of the drum (130) in a plurality of rotation angle modes.

17 Claims, 6 Drawing Sheets

(56) References Cited

U.S. PATENT DOCUMENTS

2004/0244438 A1* 12/2004 North ..... 68/23.2
2005/0268669 A1* 12/2005 Ko et al. ..... 68/12.05

FOREIGN PATENT DOCUMENTS

JP 2006314561 A 11/2006
JP 2008054950 A 3/2008
KR 2001088211 A 9/2001

OTHER PUBLICATIONS

International Search Report issued in International Application No. PCT/KR2009/005195 mailed Jun. 20, 2011.

* cited by examiner

LAUNDRY MACHINE

This application is the U.S. national stage under 35 USC §371 of International Application Number PCT/KR2009/005195, filed on Sep. 11, 1009, which claims priority to Korean Application No. 10-2009-0039049, filed on May 4, 2009, the entire contents of which is hereby incorporated by reference.

TECHNICAL FIELD

The present invention relates to a laundry machine, and more particularly, to a laundry machine that treats laundry housed in a rotating drum.

BACKGROUND ART

A laundry machine is a machine that washes or dries clothes. Representative examples of the laundry machine include a washing machine, a drying machine, and a washing and drying machine. On the other hand, the laundry machine may be classified as a drum type laundry machine that treats laundry housed in a rotating drum or a cabinet type laundry machine that treats laundry housed in a stationary space.

Based on an angle of a rotation shaft of the rotating drum, the drum type laundry machine may be classified as a horizontal shaft laundry machine or a vertical shaft laundry machine.

In the horizontal shaft laundry machine, the rotation shaft of the drum is provided approximately horizontally, and laundry is lifted and dropped with the rotation of the drum such that the laundry is treated. Of course, in recent years, a tilting laundry machine has been widely used wherein the rotation shaft of the drum is inclined at a predetermined angle. The predetermined angle may be between approximately 5 degrees and approximately 15 degrees. The horizontal shaft laundry machine is widely applied to a washing machine or a washing and drying machine as well as a drying machine. The horizontal shaft laundry machine is generally referred to as a front loading laundry machine. This is because a door is provided at the front of a cabinet such that laundry is put into or removed from the cabinet by opening the door. Generally, most drum laundry machines are classified as front loading laundry machines.

In the vertical shaft laundry machine, the rotation shaft of the drum is provided substantially vertically. The vertical shaft laundry machine is widely applied to a washing machine. The washing machine washes laundry using force of wash water generated in the drum. The force of wash water may be generated by the rotation of the drum or by a pulsator rotating in the drum. The vertical shaft laundry machine is generally referred to as a top loading laundry machine. This is because a door is provided at the top of a cabinet such that laundry is put into or removed from the cabinet by opening the door.

As the washing machine or the washing and drying machine to perform washing, the front loading laundry machine (hereinafter, referred to as a drum washing machine for the sake of convenience) and the top loading laundry machine (hereinafter, referred to as a pulsator washing machine for the sake of convenience) each have their own advantages and disadvantages.

Basically, the drum washing machine uses a smaller amount of wash water than the pulsator washing machine. Therefore, the drum washing machine has an excellent energy saving effect, and high-concentration detergent control and temperature control are easily achieved in the drum washing machine. Also, washing is performed not by force of water but by lifting and dropping laundry, with the result that damage to the laundry is low.

In the pulsator washing machine, on the other hand, laundry is washed basically in a state in which the laundry is soaked in wash water, with the result that the pulsator washing machine uses a larger amount of wash water than the drum washing machine. In particular, the pulsator washing machine performs washing using force of water, with the result that laundry becomes tangled, and therefore, the laundry may be damaged, e.g., stretched.

Basically, washing is performed with detergent, and therefore, the detergent may be completely rinsed off the laundry when the washing is completed. For this reason, consumers may assume that the pulsator washing machine, using a larger amount of water, exhibits more excellent rinsing performance.

In addition to the above matters, the drum washing machine and the pulsator washing machine have other advantages and disadvantages. Therefore, it is difficult for a specific type of washing machine to have advantages of other types of washing machines.

On the other hand, a washing machine having a rotation shaft of a drum inclined at an angle of approximately 45 degrees is disclosed. This washing machine is constructed to have advantages of the drum washing machine and the pulsator washing machine. However, this washing machine also has disadvantages. This is because an energy saving effect is not expected in a structure in which the rotation shaft of the drum is provided horizontally.

Therefore, there is a high necessity for a new type of laundry machine having advantages of the drum washing machine and the pulsator washing machine and disadvantages of which are remedied.

DISCLOSURE OF INVENTION

Technical Problem

An object of the present invention devised to solve the problem lies on a new type of laundry machine having advantages of a drum washing machine and a pulsator washing machine.

*Another object of the present invention devised to solve the problem lies on a laundry machine that is switched from a drum washing machine to a pulsator washing machine or from a pulsator washing machine to a drum washing machine according to user selection or optimum circumstance.

Another object of the present invention devised to solve the problem lies on a laundry machine wherein a tiling angle of a rotation shaft of a drum is changed as needed in a plurality of washing courses performed by rotating the drum or sub operations of each of the washing courses, thereby achieving optimum performance.

A further object of the present invention devised to solve the problem lies on a laundry machine that prevents occurrence of a children s accident.

Solution to Problem

The object of the present invention can be achieved by providing a laundry machine including a cabinet, a tub provided in the cabinet to store wash water, a drum rotatably provided in the tub to house laundry, an angle change device to change a tilting angle of a rotation shaft of the drum, and a controller to control an operation of the angle change device and a rotating operation of the drum in a plurality of rotation angle modes.

The plurality of rotation angle modes may include at least three rotation angle modes. However, two rotation angle modes may be provided in consideration of easy control, easy user manipulation, and easy manufacture.

When the two rotation angle modes are provided, the rotation angle modes may be classified into a first angle mode (hereinafter, referred to as a first mode) and a second angle mode (hereinafter, referred to as a second mode). In the first angle mode, the tiling angle of the rotation shaft of the drum may be from 0 to 15 degrees. In the first angle mode, therefore, the rotation shaft of the drum may be provided substantially horizontally. A general drum washing machine may be embodied in the first mode. In the second angle mode, the tiling angle of the rotation shaft of the drum may be from 35 to 45 degrees. A vertical shaft washing machine may be embodied in the second mode.

The cabinet may be provided with a control panel serving as a user interface. A user may start the operation of the laundry machine or may input various commands through the control panel. Also, the user may confirm information related to the operation of the laundry machine.

The control panel may include a single panel or a plurality of panels. The control panel may be provided with various interfaces such as a button, a display, a touch screen, and a rotary knob.

The control panel may include a mode selection unit to allow a user to select one of the plurality of rotation angle modes. The controller may control the operation of the angle change device and the rotating operation of the drum according to the mode selected by the mode selection unit.

The control panel may include a course selection unit to allow the user to select one of a plurality of operation courses. The course selection unit may be embodied in the form of a rotary knob. The user may select one of various washing courses through the course selection, and the controller may control the selected washing course to be performed.

The controller may control the modes to be changed according to the selected course. For example, when the user selects course A, the controller may control the course A to be performed in the first mode. When the user selects course B, on the other hand, the controller may control the course B to be performed in the second mode.

A specific washing course may include sub operations. That is, the specific washing course may include various sub operations, such as a washing operation, a rinsing operation, and a spin-drying operation. The controller may control the modes to be changed according to the sub operations during execution of the selected specific course. For example, the controller may control the washing operation to be performed in the first mode and the rinsing operation to be performed in the second mode.

In addition, the control panel may include an option selection unit to allow the user to select one of a plurality of options. The option selection unit may select an amount of wash water or spin-drying revolutions per minute (RPM). Alternatively, the option selection unit may select the number of rinsing times or soaking to soak laundry in wash water for a predetermined period of time. The controller may control the modes to be changed according to the selected option. For example, when a large amount of wash water is selected, or high spin-drying RPM is selected, the controller may control the selected option to be performed in the second mode. When a small amount of wash water is selected, or low spin-drying RPM is selected, on the other hand, the controller may control the selected option to be performed in the first mode.

The angle change device may include a hydraulic actuator having a variable length between opposite ends thereof according to the modes. Of course, a damper used in a general washing machine may have a variable length between opposite ends thereof according to vibration. In the hydraulic actuator, however, the length between the opposite ends thereof may be variable according to the modes in addition to such a damper function. Therefore, the controller may control the length between the opposite ends of the hydraulic actuator to be increased in the second mode. Also, the controller may control the length between the opposite ends of the hydraulic actuator to be decreased in the first mode. The hydraulic actuator may be provided between one side of the tub and the cabinet. Therefore, the hydraulic actuator may support the tub in the cabinet, and, in addition, change the tilting angle of the rotation shaft of the drum.

The controller may control the tilting angle of the rotation shaft of the drum to be changed during the washing operation, in particular during the rotation of the drum. In addition, the controller may control a mode having a large tilting angle, among the plurality of modes, to be maintained when the operation of the laundry machine is stopped. For example, the washing operation may be performed in the first mode or in the second mode according to user selection or as needed. However, the operation of the laundry machine may be controlled to be stopped, for example, in the second mode.

The controller may control an amount of wash water supplied to the tub to be changed according to the modes. For example, a larger amount of wash water may be controlled to be supplied to the tub in the second mode than in the first mode even when the same washing course is selected.

The cabinet may be provided at the front thereof with an opening to achieve communication between the inside and the outside of the drum. The opening may be formed in an elliptical shape extending vertically in correspondence to the plurality of angle modes.

Also, the tub may be provided at the front outer circumference thereof with an opening cover to slide inside the opening according to the plurality of angle modes to cover a portion of the opening. The opening cover may be provided with a tub opening to achieve communication with the interior of the drum.

Therefore, a user may put laundry into the drum through the opening and the tub opening.

The laundry machine may further include a door to selectively open and close the tub opening. The drum is rotated in the tub to move wash water and laundry. As a result, the wash water and the laundry in the drum may escape from the cabinet. At this time, the door selectively opens and closes the tub opening. In addition, the tub opening may be provided with a gasket. The gasket is pressed by the door to form a seal between the inside of the tub and the outside of the cabinet.

Meanwhile, the laundry machine may further include a cabinet door to selectively open and close the opening provided at the cabinet.

Both the cabinet door to selectively open and close the opening and the door to open and close the tub opening may be provided. Alternatively, either the cabinet door or the door may be provided. The cabinet door and the door may be coupled to constitute an assembly. When both the cabinet door and the door are provided, the cabinet door and the door may be operatively connected to each other. Alternatively, the cabinet door and the door may be independently operated.

When the door is operatively connected to the cabinet door such that the door is opened and closed as the cabinet door is opened and closed, the door may slide inside the cabinet door according to the plurality of angle modes.

Meanwhile, two cabinet openings may be provided when the two angle modes are provided.

In another aspect of the present invention, provided herein is a laundry machine including a cabinet, a tub provided in the cabinet to store wash water, a drum rotatably provided in the tub to house laundry, an angle change device to change a tilting angle of a rotation shaft of the drum, and a door to selectively open and close a tub opening exposed in front of the cabinet, the door being configured to be moved by changing the tilting angle.

The drum may be controlled to be driven in a plurality of rotation angle modes.

The tub opening may be provided with a gasket to form a seal between the tub opening and the door. The cabinet may be provided at the front thereof with an opening to achieve communication with the tub opening. Also, a cabinet door may be provided to selectively open and close the opening.

The object of the present invention can be achieved by providing a laundry machine including a cabinet, a tub provided in the cabinet to store wash water, a drum rotatably provided in the tub to house laundry, an angle change device to change a tilting angle of a rotation shaft of the drum, and a controller to control an operation of the angle change device and a rotating operation of the drum in a plurality of rotation angle modes.

Advantageous Effects of Invention

The laundry machine according to the present invention basically solves the problems of a conventional drum washing machine and a conventional pulsator washing machine.

More specifically, the present invention provides a new type of laundry machine having advantages of a drum washing machine and a pulsator washing machine.

Also, the present invention provides a laundry machine that is switched from a drum washing machine to a pulsator washing machine or from a pulsator washing machine to a drum washing machine according to user selection or optimum circumstance.

Also, the present invention provides a laundry machine wherein a tiling angle of a rotation shaft of a drum is changed as needed in a plurality of washing courses performed by rotating the drum or sub operations of each of the washing courses, thereby achieving optimum performance.

Also, the present invention provides a laundry machine that prevents occurrence of a children's accident.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
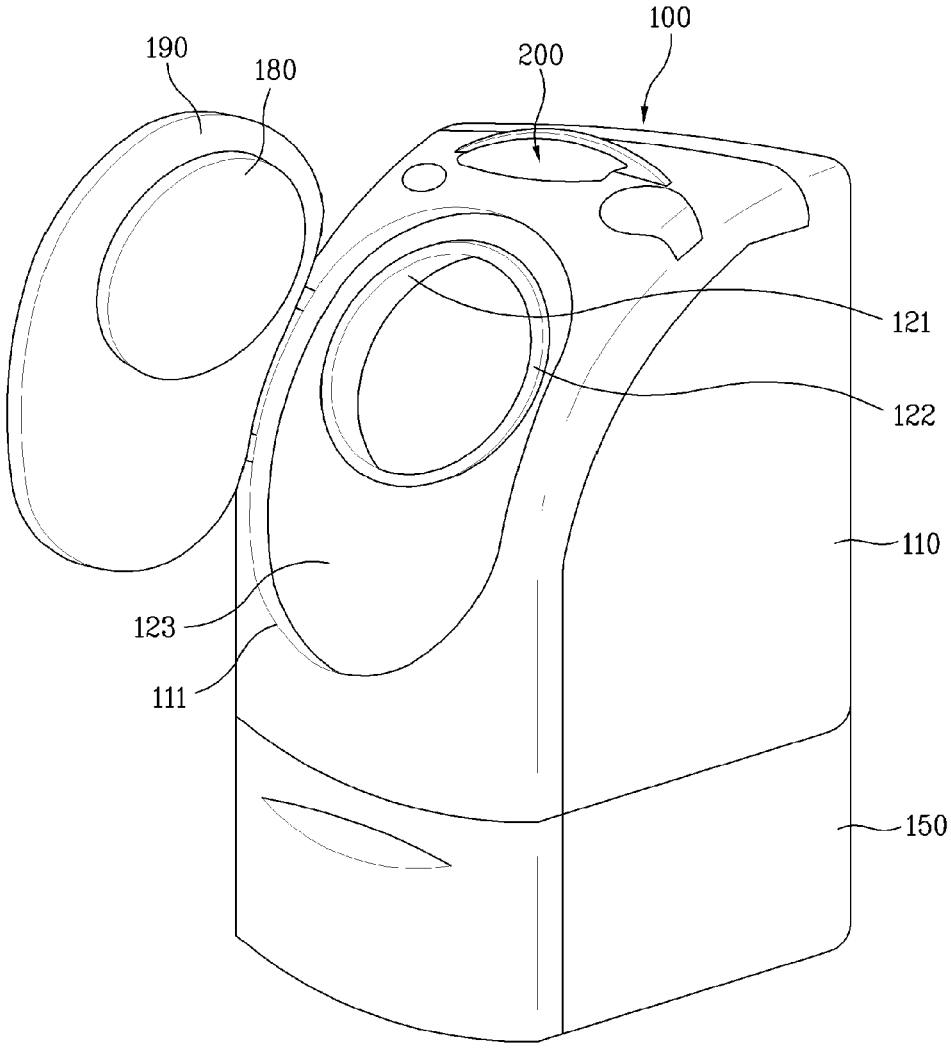
FIG. 1 is a perspective view illustrating a laundry machine according to an embodiment of the present invention.
Figure 2:
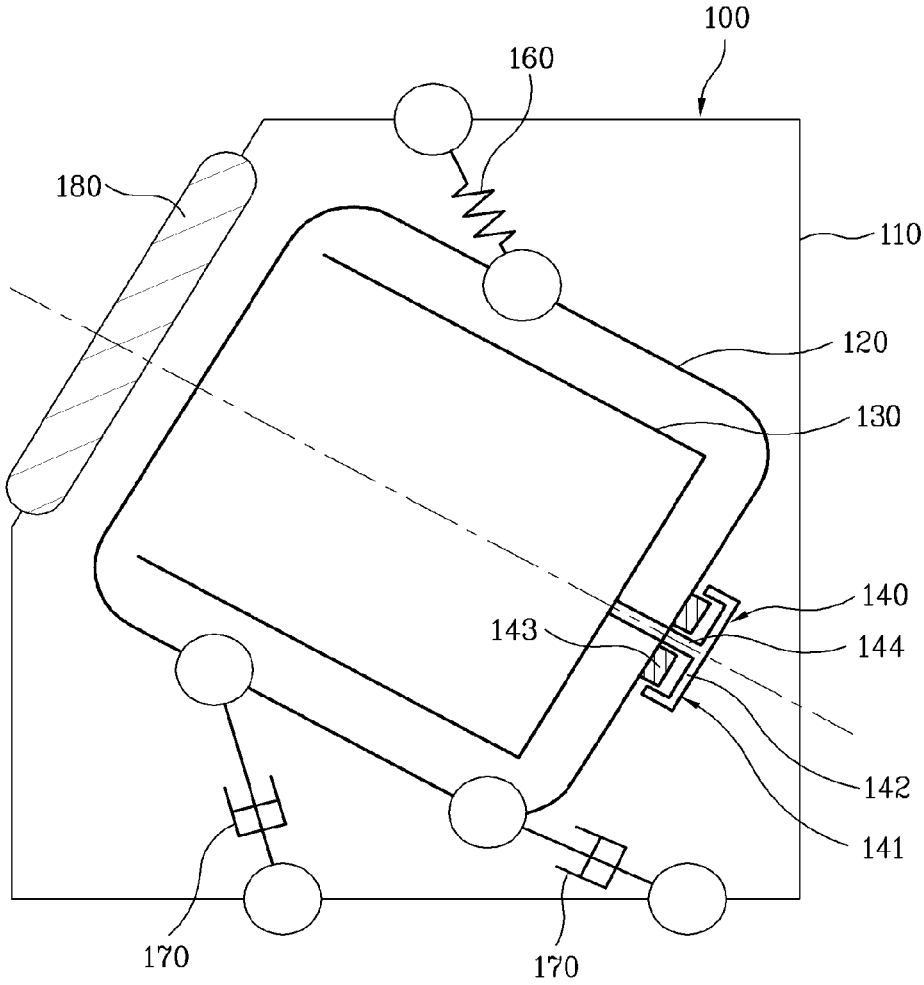
FIG. 2 is a sectional view of the laundry machine in a second angle mode.

As shown in FIGS. 1 and 2, a laundry machine 100 according to an embodiment of the present invention includes a cabinet 110 forming the external appearance of the laundry machine 100.

As shown in FIG. 2, a tub 120 is provided inside the cabinet 110. The tub 120 is configured to store wash water. A drum 130 is rotatably provided inside the tub 120. The drum 130 is a space to house laundry. In the drum 130, washing is performed using detergent and wash water.

Inside the cabinet 110 is provided a drive unit 140 to rotate the drum 130. The drive unit 140 includes a motor 141 and a drive shaft, i.e., a rotation shaft 144. The motor 141 is controlled by a controller (not shown) to rotate the drum 130 via the rotation shaft 144.

The motor 141 may include a rotor 142 and a stator 143. The rotor 142 may be an outer rotor type motor configured to be rotated outside the stator 143.

The stator 143 is fixed to a rear wall 143 of the tub 120. One end of the rotation shaft 144 is fixed to a rear wall of the drum 130. The other end of the rotation shaft 144 is connected to the rotor 142 through the rear wall 143 of the tub 120. Consequently, the motor 141 is provided at the rear wall 143 of the tub 120 to directly transmit rotational force from the rotor 142 to the rotation shaft 144. This drum drive method may be referred to as a direct connection type drive method.

In this embodiment, such a direct connection type drive method is very advantageous. This is because the motor 140 is provided at the rear wall 143 of the tub 120 without being affected by other components. That is, even when a tiling angle of the tub 120 is changed, relative positions among the motor 140, the tub 120, the rotation shaft 144, and the drum 130 do not change. In a drive method in which drive force from the motor 140 is transmitted to the rotation shaft 144 via a pulley, on the other hand, relative positions between the motor 140 and the rotation shaft 144 may change as the tilting angle of the tub 120 is changed. In this case, therefore, a mechanism to transmit rotational force from the motor 140 to the rotation shaft 144 may be very complicated.

In this embodiment, a tiling angle of the rotation shaft 144 of the drum 130 is variable. An angle change device is provided to change the tilting angle of the rotation shaft 144 of the drum 130.

Generally, the tub 120 is supported inside the cabinet 110 by a spring 160 and dampers 170. The spring 160 and the dampers 170 minimize vibration generated during the operation of the laundry machine 100.

The angle change device may be embodied by the dampers 170. The angle change device 170 may include a hydraulic actuator. That is, the angle change device 170 may have a hydraulic piston provided therein. The hydraulic actuator may have a variable length between opposite ends thereof. That is, the length between the opposite ends of the hydraulic actuator may be small in a first mode, and the length between the opposite ends of the hydraulic actuator may be large in a second mode. When the controller applies electric current to the hydraulic actuator, the length between the opposite ends of the hydraulic actuator corresponding to the first mode may be changed to the length between the opposite ends of the hydraulic actuator corresponding to the second mode. When the application of electric current to the hydraulic actuator by the controller is interrupted, on the other hand, the length between the opposite ends of the hydraulic actuator corresponding to the second mode is changed to the length between the opposite ends of the hydraulic actuator corresponding to the first mode. Alternatively, when the controller applies electric current to the hydraulic actuator, the length between the opposite ends of the hydraulic actuator corresponding to the second mode may be changed to the length between the opposite ends of the hydraulic actuator corresponding to the first mode.

Consequently, the tiling angle of the drum rotation shaft 144 may be changed, and, at the same time, vibration generated from the tub 120 may be absorbed by the hydraulic actuator.

A plurality of angle change devices 170 may be provided. The angle change devices 170 may be mounted between the outer circumference of the tub 120 and the cabinet 110. FIG. 2 illustrates the angle change devices 170 as being provided at front and rear ends of the bottom of the outer circumference of the tub 120.

As shown in FIG. 1, the laundry machine 100 includes a control panel 200. The control panel 200 may be provided at the front of the cabinet 110. The control panel 200 is provided to serve as a user interface.

Also, a cabinet opening 111 is provided at the front of the cabinet 110. The cabinet opening 111 is provided to achieve communication between the outside and the inside of the cabinet 110.

A tub opening 121 is located in a region where the cabinet opening 111 is formed. The internal space of the drum 130 provided in the tub 120 communicates with the outside of the cabinet 110 through the tub opening 121.

Consequently, a user may put laundry into the drum 130 through the cabinet opening 111 and the tub opening 121.

Meanwhile, a door 180 may be provided to open and close the tub opening 121. After laundry, wash water, and detergent are put into the drum 130, the drum 130 is rotated to perform washing. At this time, it is necessary to prevent the wash water or the laundry from escaping from the drum 130. To this end, the tub opening 121 is closed by the door 180. At the circumference of the tub opening 121 may be provided a gasket 122 for sealing.

Also, a cabinet door 190 may be provided to open and close the cabinet opening 111.

The laundry machine 100 may simultaneously function as a drum washing machine and as a pulsator washing machine. The pulsator washing machine is advantageous in that the cabinet opening 111 and the tub opening 121 are located at the top of the cabinet 110, and therefore, a user may put laundry into the pulsator washing machine without bending over or without crouching. In this embodiment, the laundry machine 100 may have such convenience.

As shown in FIG. 2, the rotation shaft 144 is not substantially vertical in the first mode. For example, the rotation shaft 144 may be inclined at an angle of approximately 40 degrees to a horizontal line. In this case, the position of the tub opening 121 is raised, with the result that easy and convenient use of the laundry machine 100 is achieved. Even in this case, of course, a user may be forced to bend over to some extent. To prevent the user from having to bend over, a pedestal 150 may be provided below the laundry machine 100. The pedestal 150 may be integrally formed with the cabinet 110. Alternatively, the pedestal 150 and the cabinet 110 may be separately manufactured and then coupled to each other.

The pedestal 150 has a space independent of the drum 130. The pedestal 150 may be manufactured in the form of a drawer which a user opens and closes from the front. The interior of the pedestal 150 may be a space to receive articles, such as detergent. Alternatively, the interior of the pedestal 150 may be a space in which laundry is treated, e.g., washed or dried, in addition to the drum 130.

The position of the cabinet opening 111 or the tub opening 121 may be raised by the provision of the pedestal 150, with the result that a user may easily and conveniently put laundry into or remove laundry from the laundry machine 100 without bending over as in the pulsator washing machine. In addition, an auxiliary clothes treating device may be provided in the pedestal 150 to further improve user convenience.

That is, the pedestal 150 may have a space provided below the cabinet 110 to perform different functions than washing performed in the drum 130, thereby improving user convenience. On the other hand, the pedestal 150 raises the position of the tub opening 121 such that a user may use the laundry machine 100 along the optimum traffic line (moving line).

The above-described modes will be described in more detail with reference to FIGS. 2 and 3.

*Referring to FIG. 2, the rotation shaft 144 is inclined at an angle of approximately 40 degrees. That is, the rotation shaft 144 is inclined at an angle of approximately 40 degrees to a horizontal line or a cabinet base. In this mode, the length between the opposite ends of each of the angle change devices 170 is large.

Figure 3:
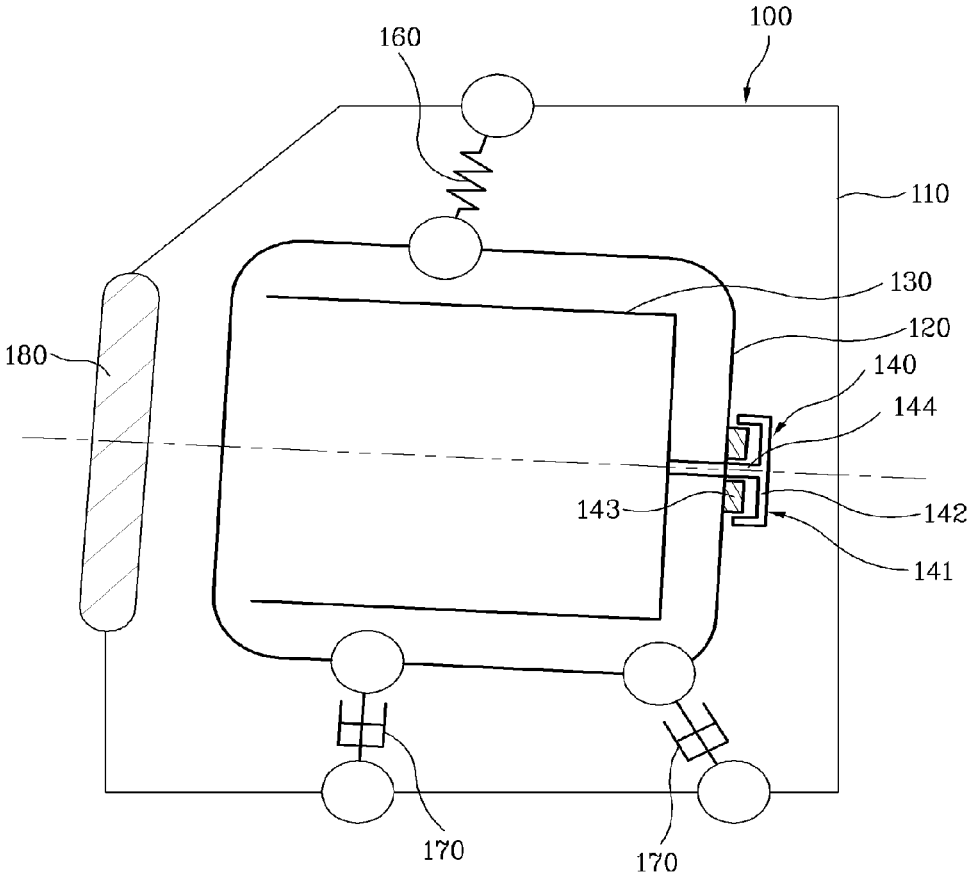
FIG. 3 is a sectional view of the laundry machine in a first angle mode.

Referring to FIG. 3, on the other hand, the rotation shaft 144 is inclined at an angle of approximately 10 degrees. In this mode, the length between the opposite ends of each of the angle change devices 170 is small.

The tub 120 is supported in the cabinet 110 by the spring 160 or the dampers 170 such that vibration from the tub 120 is not transmitted to the cabinet 110 as previously described. Consequently, the angle change device may be embodied by the dampers or an additional structure. As an easy example, the front of the tub 120 may be lifted upward to further incline the rotation shaft 144.

Meanwhile, the rotation shaft 144 of the drum 130 may be inclined by inclining the tub 120. This is because the rotation shaft 144 of the drum 130 is supported in the tub 120 through the rear wall 143 of the tub 120. To this end, a bearing housing (not shown) to rotatably support the rotation shaft 144 is provided at the rear wall 143 of the tub 120. The bearing housing exhibits sufficient strength, and therefore, the drum 130 is rotatably supported in the tub 120 in a state in which the front of the drum 130 is not supported.

The position of the door 180 is schematically shown in FIGS. 2 and 3. The door 180 opens and closes the tub opening 121 (See FIG. 1). When the rotation shaft 144 of the drum 130 is changed, the position of the tub opening 121 is also changed. For this reason, the position of the door 180 to open and close the tub opening 121 must be changed. That is, the door 180 must interlock with the angle change devices 170 such that the position of the door 180 is changed. Such a door position change structure will be described later.

As previously described, the drum washing machine is embodied in the first mode, and the pulsator washing machine is embodied in the second mode. In this embodiment, therefore, the laundry machine 100 simultaneously functions as the drum washing machine and as the pulsator washing machine.

The first mode and the second mode may be embodied in various forms, which will be described hereinafter in detail.

As shown in FIG. 1, the control panel 200, serving as the user interface, may be provided at the cabinet 110.

The control panel 200 may include a mode selection unit to allow a user to select one of a plurality of modes. The mode selection unit may be embodied in various forms, such as a dial, a button, and a touch screen.

The user may select a specific mode through the mode selection unit. For example, a first mode may be selected to drive the laundry machine 100. When the first mode is selected, washing effect or performance of a drum washing machine may be embodied. When a second mode is selected, on the other hand, washing effect or performance of a pulsator washing machine may be embodied.

The washing effect or performance is not simply limited to washing of laundry. The washing effect or performance includes rinsing performance, spin-drying performance, convenience, and energy efficiency in addition to the washing performance.

For example, when a user considers only convenience, the second mode may be selected, and therefore, all washing operations may be performed in the second mode. Consequently, the user may easily and conveniently put laundry into or remove laundry from the laundry machine before or after washing. In the same manner, when the user believes that rinsing performance needs a large amount of water, the second mode may be selected, and therefore, all washing operations may be performed in the second mode.

On the other hand, when the user considers energy efficiency or washing performance, the first mode may be selected, and therefore, all washing operations may be performed in the first mode.

Also, the control panel may include a course selection unit to allow a user to select one of a plurality of courses. The course selection unit may be embodied in the form of a rotary knob.

*Generally, the washing machine is operated in various washing courses, such as a normal course, a delicate clothes course, and a bedclothes course, depending upon kinds of laundry to be washed. The washing courses may be variously set based on washing purposes. Also, a large capacity course or a small capacity course may be set depending upon the amount of laundry to be washed.

In a drum washing machine, laundry is repeatedly lifted and dropped, with the result that the laundry is washed. In this washing method, however, delicate clothes may be damaged. Of course, the delicate clothes may be damaged due to friction between the delicate clothes and the drum although revolutions per minute (RPM) of the drum is decreased. Therefore, laundry may be washed, while rotating the drum at low RPM, in a state in which the laundry is soaked in wash water. That is, the laundry may be washed using a pulsator washing method. In this case, however, the laundry must be prevented from being damaged due to excessive water current.

In various courses classified depending upon washing purposes or kinds of laundry to be washed, therefore, a drum washing method or a pulsator washing method may be more effective. Consequently, the controller may differently control the mode depending upon courses. For example, when a user selects a delicate clothes course, a washing operation may be controlled to be performed in the second mode. On the other hand, when the user selects a normal course, a washing operation may be controlled to be performed in the first mode.

Meanwhile, each of the various courses may include a plurality of sub operations. For example, the normal course may include a washing operation, a rinsing operation, and a spin-drying operation. Of course, drainage of water from the tub and intermediate spin-drying after the drainage may be included in the sub operations. Consequently, the angle mode may be controlled to be changed depending upon a selected one of the sub operations while one of the courses is performed. For example, the washing operation may be controlled to be performed in the first mode, and the rinsing operation may be controlled to be performed in the second mode.

The control panel may include an option selection unit to allow a user to select one of various options. The options may include a wash water level (an amount of wash water), spin-drying RPM, and an amount of laundry.

As previously described, it is not possible to use a large amount of wash water in the first mode due to a structural limit of the laundry machine. On the other hand, it is possible to use a large amount of wash water in the second mode. When a user selects a high wash water level, therefore, the option may be performed in the second mode. When the user selects a low wash water level, on the other hand, the option may be performed in the first mode.

Also, a larger amount of laundry may be washed in the second mode than in the first mode. That is, it is possible to wash a relatively large amount of laundry in the second mode. This is because a large amount of laundry is placed in the same drum due to weight of the laundry. Consequently, when a user selects an option of large capacity, the option may be performed in the second mode. On the other hand, when the user selects an option of small capacity, the option may be performed in the first mode. This capacity-related information may be equally applied to each of the courses. For example, when the normal course is selected, and a large amount of laundry is detected, washing may be performed in the second mode. On the other hand, when the normal course is selected, and a small amount of laundry is detected, washing may be performed in the first mode.

In connection with the spin-drying performance, a drum washing machine is superior to a pulsator washing machine since laundry is easily dispersed and untangled, and the laundry is spin-dried at a high speed. However, the drum washing machine is inferior to the pulsator washing machine in that the drum washing machine has low RPM in a resonance frequency band, whereby the drum washing machine requires a longer time to enter main spin-drying than the pulsator washing machine. Consequently, spin-drying may be performed in the first mode when high-speed spin-drying is selected, and spin-drying may be performed in the second mode when low-speed spin-drying is selected. Alternatively, spin-drying may be performed in the second mode when high-speed spin-drying is selected, and spin-drying may be performed in the first mode when low-speed spin-drying is selected.

As previously described, a washing operation is controlled to be performed in a plurality of drum rotation angle modes according to a user selection or according to a predetermined program. That is, the drum is controlled to be rotated in the respective modes. The modes may be uniformly maintained in a series of washing operations. Alternatively, the modes may be varied according to options or sub operations.

In addition, the controller may control a mode having a large tilting angle, among the plurality of modes, to be maintained when the operation of the laundry machine is stopped. The stoppage of the operation of the laundry machine does not mean only that the drum is not rotated between sub operations. That is, the stoppage of the operation of the laundry machine includes a case in which the operation of the laundry machine is paused by a user pushing a pause button as well as a case in which the operation of the laundry machine is completely stopped. In other words, the stoppage of the operation of the laundry machine means a state in which the user may put laundry into or remove laundry from the drum. In this state, therefore, a mode having a large tilting angle may be controlled to be maintained for user convenience.

For example, a user may push the pause button to put additional laundry into the drum while washing is being performed in the first mode. In this case, the rotation of the drum is stopped, and the user puts additional laundry into the drum. Therefore, switching from the first mode to the second mode is performed such that the user more easily puts laundry into the drum. In other words, the rotation of the drum may be stopped, switching to the second mode may be performed, and the user may open the door.

A children s accident may occur during the operation of the drum washing machine. That is, the door may be closed, while a child is in the drum, with the result that the child may suffocate. This is because the position of the drum opening, i.e., the tub opening, is low, and therefore, children may easily enter the drum. In order to prevent such an accident, therefore, the laundry may be maintained in the second mode when the washing operation is completed as well as when the washing operation is paused, i.e., at normal times. In the second mode, the position of the door is located higher than the height of the most children, and, in addition, the position of the tub opening is also high, with the result that it is difficult for children to enter the drum, thereby preventing occurrence of a children s accident.

In consideration of the height of a user, the user may change the angle of the second mode. Of course, the user may change the angle of the drum rotation shaft, when the washing operation is stopped, without changing the angle of the first mode and the angle of the second mode.

The angle of the first mode and the angle of the second mode may be predetermined to optimum angles. The angle of the first mode is provided to embody a drum washing machine, and the angle of the second mode is provided to embody a pulsator washing machine. Therefore, the angles of the respective modes may be predetermined to perform optimum functions.

When the user is short, the position of the tub opening may be relatively high. When the user is tall, on the other hand, the position of the tub opening may be relatively low. Consequently, a user may select an angle of the drum rotation shaft when the washing operation is stopped such that the user may easily put laundry into the drum in addition to the angle of the first mode and the angle of the second mode. That is, it may be possible to change the position of the tub opening, such that the user easily puts laundry into or removes laundry from the drum, in consideration of the height of the user irrespective of washing functions.

To this end, the laundry machine may include a stoppage angle selection unit (not shown). The stoppage angle selection unit may be provided at the control panel. A user may select a specific angle between the first mode and the second mode through the stoppage angle selection unit. Of course, the angle of the first mode or the angle of the second mode may be selected as the stoppage angle.

When the user is short, therefore, the tilting angle of the drum rotation shaft may be set to, for example, 30 degrees through the stoppage angle selection unit such that the user easily and conveniently puts laundry into the drum. When the height of the user is large, on the other hand, the tilting angle of the drum rotation shaft may be set to, for example, 45 degrees or more within an allowable range through the stoppage angle selection unit such that the user easily and conveniently puts laundry into the drum.

In this embodiment, the laundry machine may include a movable door. Here, the term movable does not mean that the door is movable to be opened and closed but that the door is movable with the change of the angle of the drum rotation shaft.

In the laundry machine, the tub opening 121 is exposed in front of the drum 130 through the cabinet opening 111. Also, the angle of the rotation shaft 144 of the drum 130 is tilted, with the result that the tub opening 121 may be sealed. Therefore, the door may be provided such that the door is movable with the change of the angle of the rotation shaft 144 of the drum 130 in consideration of the above points.

Hereinafter, a door structure will be described in detail.

Figure 4:
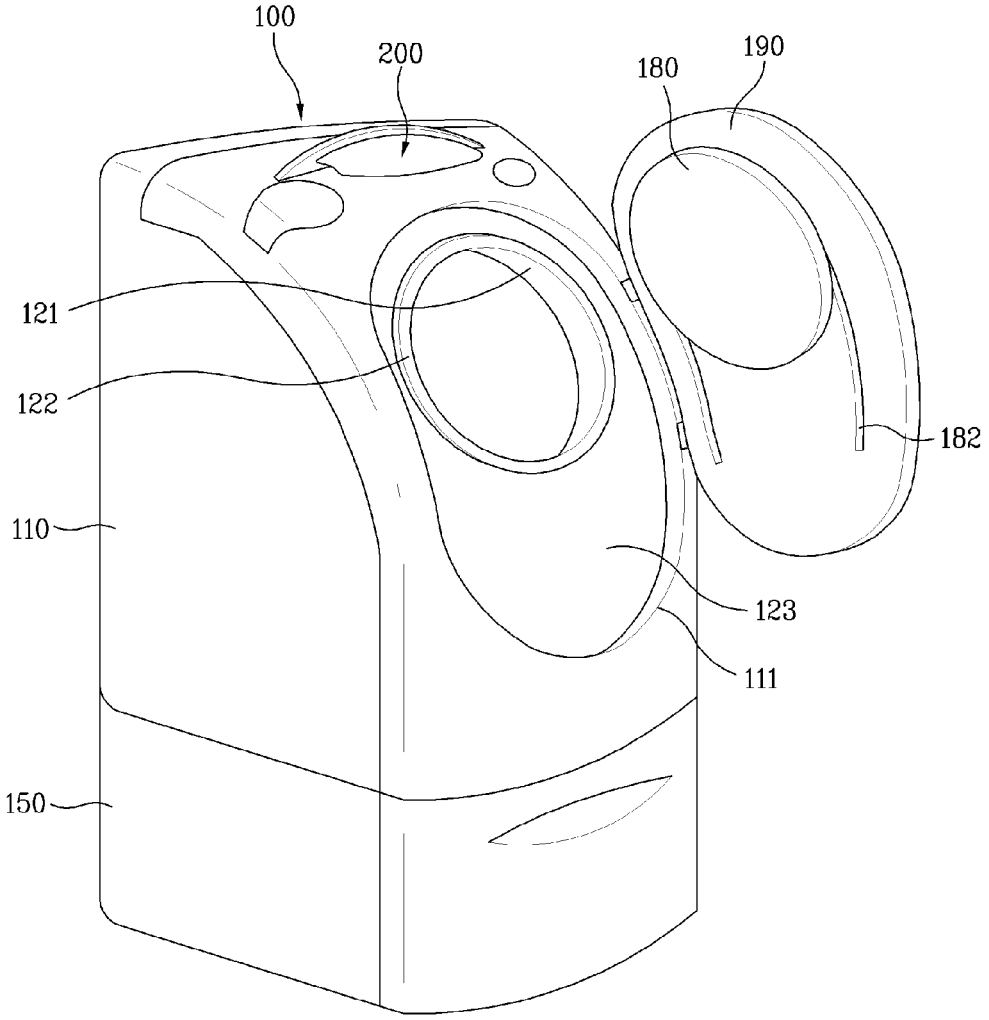
FIG. 4 is a perspective view illustrating an embodiment of a door structure of the laundry machine.

FIG. 4 illustrates an embodiment of a door structure of the laundry machine.

As shown in FIG. 4, the cabinet door 190 may be provided at the front of the cabinet 110 to selectively open and close the cabinet opening 111. The cabinet door 180 harmonizes with other components at the front of the cabinet 110 to provide an aesthetically pleasing appearance. At the front of the cabinet 110 is provided a door glass through which a user may confirm the progress of the washing operation from outside.

The cabinet door 190 may be hingedly mounted to the cabinet 110 in the same manner as a door of a general drum washing machine to open and close the cabinet opening 111.

Meanwhile, the door 180 to open and close the tub opening 121 may be provided inside the cabinet door 190. Therefore, the door 180 may have a size corresponding to that of the tub opening 121.

The door 180 may be operatively connected to the cabinet door 190 such that the door 180 is opened and closed simultaneously when the cabinet door 190 is opened and closed. The cabinet door 190 and the door 180 are coupled to constitute an assembly. When the cabinet door 190 is closed, therefore, the door 180 may close the tub opening 121. When the cabinet door 190 is opened, on the other hand, the door 180 may open the tub opening 121.

The cabinet door 190 is hingedly mounted to the front of the cabinet 110 to open and close the cabinet opening 111. However, the frontward-and-backward and left-and-right movement of the cabinet door 190 is not allowed. On the other hand, the tub opening 121 may be moved according to angle modes.

As shown in FIG. 4, the tub opening 121 is formed in a circular shape. According to angle modes, the tub opening 121 may be moved upward or downward. Correspondingly, the cabinet opening 111 may be formed in a vertically elliptical shape.

Since the tub opening 121 is movable, the door 180 to open and close the tub opening 121 must be moved simultaneously with the movement of the tub opening 121. To this end, the door 180 may be movably mounted to the cabinet door 190.

Also, rails 182 corresponding to the movement route of the door 180 may be provided at the cabinet door 190. The door 180 may be moved along the rails 182. FIG. 4 illustrates the door 180 being moved upward, i.e., the door 180 being in the second angle mode.

When the cabinet door 190 is closed, the door 180 is also closed. At this time, the tub opening 121 is moved downward when the angle mode is changed from the second angle mode to the first angle mode. Since the door 180 is in tight contact with the tub opening 121, the door 180 also slides downward on the cabinet door 190. Therefore, the door may be moved according to modes in a state in which the cabinet door 190 and the door 180 are closed, whereby it is possible to change the modes even during washing operation.

Meanwhile, it is necessary to prevent the door 180 from being in the second mode when the tub opening 121 is in the first mode. To this end, mode change may be controlled to be achieved after the cabinet door 190 and/or the door 180 is completely closed.

In this embodiment, a user may open the door 180 through only a manipulation. That is, when the cabinet door 190 is opened, the door 180 may also be opened.

Unlike a normal drum washing machine, the cabinet opening 111 may have a longer vertical width than the tub opening 121. This is because the tub opening 121 may be moved upward and downward. For this reason, the interior of the cabinet 110 may be exposed outside through the cabinet opening 111. When the cabinet door 180 is closed, the cabinet opening 111 is completely closed by the cabinet door 180. When the cabinet door 180 is opened, however, appearance- and safety-related problems may be caused.

Therefore, the tub 120 may be provided at the front outer circumference thereof with an opening cover 123 to cover a portion of the cabinet opening 111. The opening cover 123 covers the upper part of the cabinet opening 111 in the first mode. On the other hand, the opening cover 123 covers the lower part of the cabinet opening 111 in the second mode.

The opening cover 123 slides inside the cabinet opening 111 to cover a portion of the cabinet opening 111.

Meanwhile, the opening cover 123 may be exposed outside through the transparent cabinet door 190. In addition, when the cabinet door 190 is opened, the opening cover 123 is exposed in front of the cabinet 110. Consequently, the cabinet cover 123 may have the same surface gloss, material quality, texture, and color as the front of the cabinet 110.

Mode for the Invention

Figure 5:
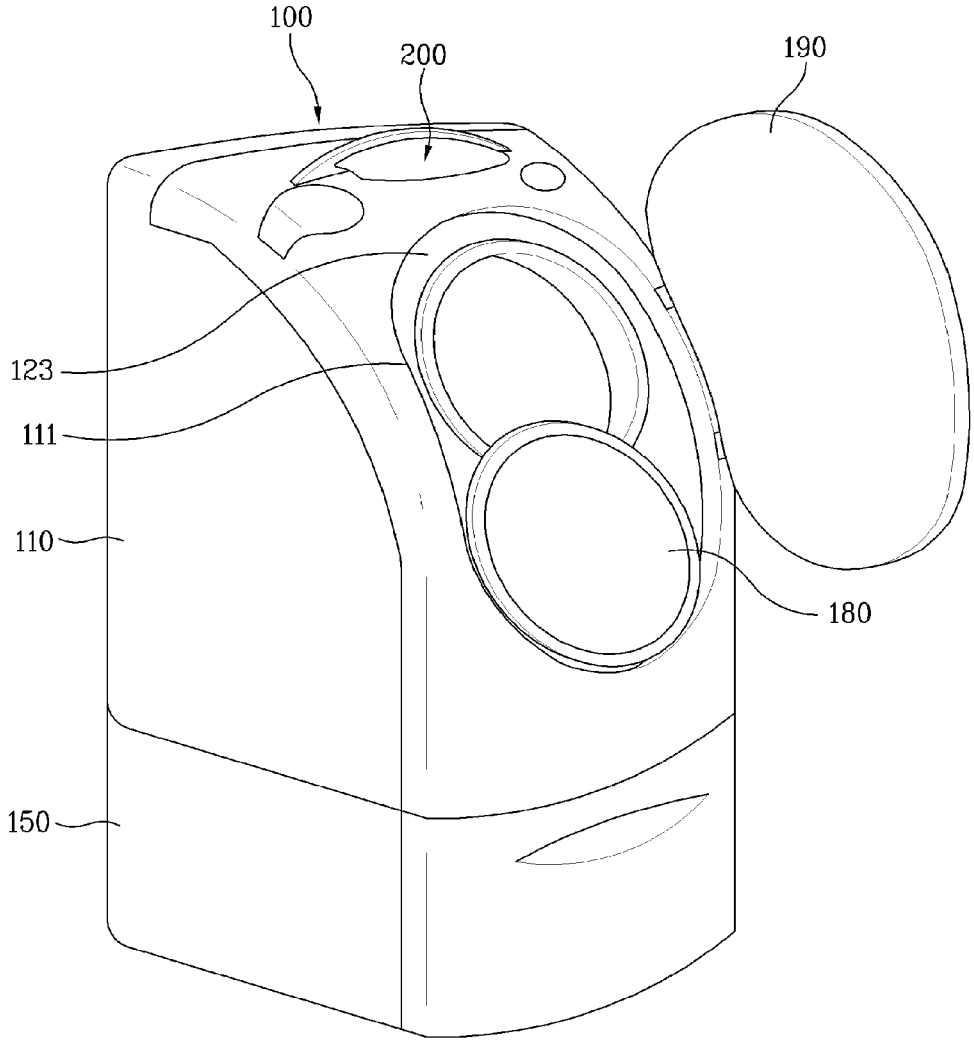
FIG. 5 is a perspective view illustrating another embodiment of the door structure of the laundry machine.
Figure 6:
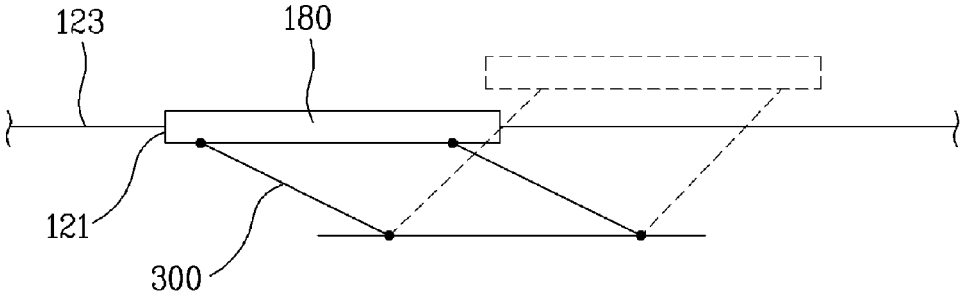
FIG. 6 is a sectional view schematically illustrating a door opening and closing device of the door structure shown in FIG. 5.

FIGS. 5 and 6 illustrate another embodiment of the door structure.

In this embedment, the cabinet door 190 and the door 180 are separately provided. A user opens the cabinet door 190 first, and then opens the door 180, which closes the tub opening inside the cabinet door 190. That is, opening operations are performed twice for the user to put laundry into the drum.

In this embodiment, the door 180 is not fixed to the cabinet 110 unlike the cabinet door 190. Therefore, the door 180 may be operatively connected to the movable tub, whereby the movement of the door 180 is achieved.

The door 180 may be provided at the opening cover 123. When the opening cover 123 is moved according to the modes, the door 180, provided at the opening cover 123, may be moved according to the modes.

It may be very inconvenient for the user to open two doors. For this reason, the door 180 may be controlled to be automatically opened and closed when the cabinet door 190 is opened and closed by the user. To this end, an opening and closing device 300 may be provided to automatically open and close the door 180.

As shown in FIG. 6, the opening and closing device 300 may be configured including a link structure. With the rotation of the link structure, the door 180 may open and close the tub opening 121. Solid lines indicate the door 180 in a closed state, and dotted lines indicate the door 180 in an open state.

*The opening and closing device 300 may be operatively connected to the cabinet door 190 such that the opening and closing device 300 opens and closes the door 180 when the cabinet door 190 is opened and closed. That is, when the cabinet door 190 is opened, the link structure is rotated to open the door 180. In this case, the link structure may be provided with an elastic member. The elastic member may be configured to generate an elastic restoring force in the direction in which the door is opened. When the cabinet door 190 is opened, therefore, the door 180 is opened by the elastic restoring force. When the cabinet door 190 is closed, on the other hand, the elastic member is pressed by the cabinet door, with the result that the door 180 is closed.

Also, the opening and closing device 300 may include a drive unit, such as a motor (not shown), and may be operatively connected to the cabinet door such that opening and closing device 300 opens and closes the door 180 when electric current is supplied to the motor. In this case, the motor may be a stepper motor. Even when no electric power is applied to the laundry machine, it may be necessary to open the cabinet door 190 and the door 180. Therefore, electric current may be supplied to the motor through an additional rechargeable battery (not shown). The rechargeable battery may be controlled to be charged when electric power is applied to the laundry machine.

When the opening of the cabinet door 190 is detected through electrically and mechanically operative connection, therefore, electric current is supplied to the motor, with the result that the door 180 is opened. On the other hand, when the closing of the cabinet door 190 is detected, the door 180 may be automatically closed.

Figure 7:
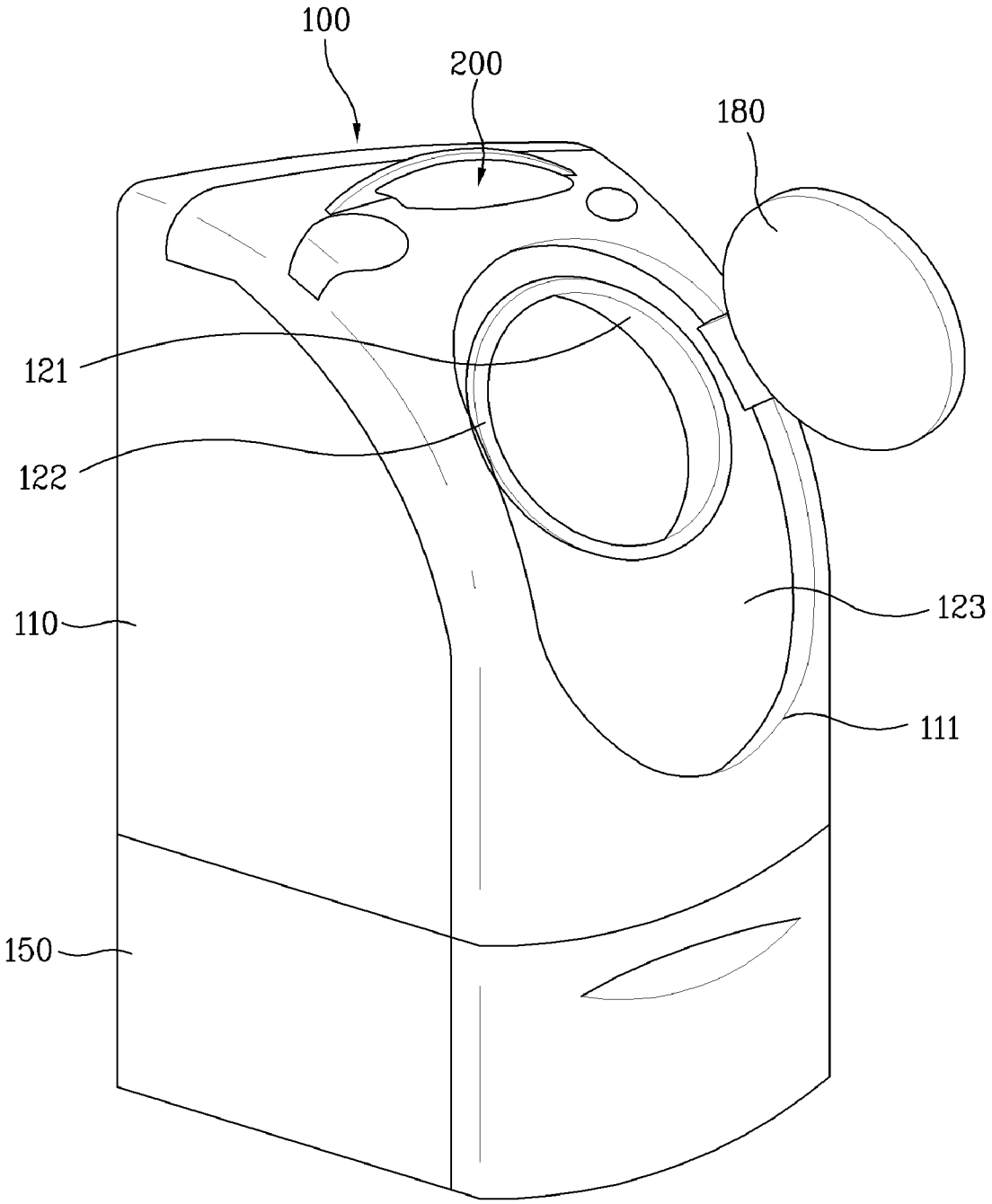
FIG. 7 is a perspective view illustrating a further embodiment of the door structure of the laundry machine.

FIG. 7 illustrates a further embodiment of the door structure.

In this embedment, only a door 180 is provided. The door 180 according to this embodiment is similar to a door of a general drum washing machine. However, the door 180 according to this embodiment is not supported at the cabinet but at the tub. When the tub is moved, therefore, the door 180 is also moved. More specifically, the door 180 may be supported at the opening cover 123. That is, a hinge may be provided at the opening cover 123.

In this embodiment, the opening cover 123 is exposed in front of the cabinet. Consequently, the cabinet cover 123 may have the same surface gloss, material quality, texture, and color as the other components at the front of the cabinet 110.

Although not shown, on the other hand, a plurality of cabinet openings 111, e.g., two cabinet openings 111, may be provided. That is, one of the cabinet openings 111 may correspond to the tub opening in the first mode, and the other cabinet opening 111 may correspond to the tub opening in the second mode. In this case, it is not necessary to form the cabinet openings 111 in a vertically elliptical shape unlike the previous embodiments.

Industrial Applicability

The present invention provides a new type of laundry machine having advantages of a drum washing machine and a pulsator washing machine.

Also, the present invention provides a laundry machine that is switched from a drum washing machine to a pulsator washing machine or from a pulsator washing machine to a drum washing machine according to user selection or optimum circumstance.

Also, the present invention provides a laundry machine wherein a tiling angle of a rotation shaft of a drum is changed as needed in a plurality of washing courses performed by rotating the drum or sub operations of each of the washing courses, thereby achieving optimum performance.

Also, the present invention provides a laundry machine that prevents occurrence of a children's accident.

Therefore, the present invention has industrial applicability.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry machine comprising:

a cabinet comprising a control panel serving as a user interface, the control panel comprising at least one unit selected from a group consisting of a mode selection unit to allow a user to select one of the plurality of rotation angle modes, a course selection unit to allow the user to select one of a plurality of operation courses, and an option selection unit to allow the user to select one of a plurality of options, and a stoppage angle selection unit to allow the user to select the tilting angle of the rotation shaft in a state in which washing operation is stopped;

a tub provided in the cabinet to store wash water;

a drum rotatably provided in the tub to house laundry;

an angle change device to change a tilting angle of a rotation shaft of the drum;

a controller to control an operation of the angle change device and a rotating operation of the drum in a plurality of rotation angle modes; and a door to open the tub, wherein the position of the door is variable according to the tilting angle of the shaft.

2. The laundry machine according to claim 1, wherein the controller controls the modes to be changed according to the selected mode and/or the selected course and/or a sub operation during execution of the selected course and/or the selected option.

3. The laundry machine according to claim 1, wherein the angle change device comprises a hydraulic actuator having a variable length between opposite ends thereof according to the modes.

4. The laundry machine according to claim 3, wherein the hydraulic actuator is provided between one side of the tub and the cabinet.

5. The laundry machine according to claim 1, wherein the controller controls a mode having a large tilting angle, among the plurality of modes, to be maintained when the operation of the laundry machine is stopped.

6. The laundry machine according to claim 1, wherein the controller controls an amount of wash water supplied to the tub to be changed according to the modes.

7. The laundry machine according to claim 1, wherein the cabinet is provided at a front thereof with an opening to achieve communication between an inside and an outside of the drum.

8. The laundry machine according to claim 7, wherein the opening is formed in an elliptical shape extending vertically in correspondence to the modes.

9. The laundry machine according to claim 8, wherein the tub is provided at a front outer circumference thereof with an opening cover to slide inside the opening according to the modes to cover a portion of the opening.

10. The laundry machine according to claim 9, wherein the opening cover is provided with a tub opening to achieve communication with an interior of the drum, and the door to selectively open and close the tub opening.

11. The laundry machine according to claim 10, further comprising a door to selectively open and close the tub opening.

12. The laundry machine according to claim 11, wherein the door is operatively connected to the angle change device such that the door is moved when the angle change device is driven.

13. The laundry machine according to claim 12, further comprising a cabinet door to selectively open and close the opening.

14. The laundry machine according to claim 7, further comprising a cabinet door to selectively open and close the opening, wherein the door is provided to open and close a tub opening inside the cabinet door.

15. The laundry machine according to claim 14, wherein the door is operatively connected to the cabinet door such that the door is opened and closed when the cabinet door is opened and closed.

16. The laundry machine according to claim 15, wherein the door is configured to slide inside the cabinet door according to the modes.

17. The laundry machine according to claim 16, wherein the door is operatively connected to the angle change device such that the door is moved when the angle change device is driven.

* * * * *